US007004057B2

(12) United States Patent
Wright

(10) Patent No.: US 7,004,057 B2
(45) Date of Patent: Feb. 28, 2006

(54) AMMUNITION FEEDER

(76) Inventor: Jeffrey Donald Wright, 2163 Falcon Ridge Dr., Petaluma, CA (US) 94954

( * ) Notice: Subject to any disclaimer, the term of this patent is extended or adjusted under 35 U.S.C. 154(b) by 0 days.

(21) Appl. No.: 10/672,594

(22) Filed: Sep. 27, 2003

(65) Prior Publication Data

US 2005/0081420 A1 Apr. 21, 2005

(51) Int. Cl.
*F41A 9/29* (2006.01)

(52) U.S. Cl. ..... 89/34; 42/90; 89/33.01; 89/35.01

(58) Field of Classification Search ..... 42/49.02, 42/87, 88, 90; 89/34, 33.01, 35.01, 1.4
See application file for complete search history.

(56) References Cited

U.S. PATENT DOCUMENTS 1,436,227 A * 11/1922 Angier et al. ..... 89/35.01
2,828,732 A * 4/1958 Harry Horowitz et al. ... 124/29
3,153,500 A * 10/1964 Pachmayr et al. ..... 224/245
5,600,083 A * 2/1997 Bentley et al. ..... 89/33.02
6,276,253 B1 * 8/2001 Sprenger et al. ..... 89/35.01
6,286,243 B1 * 9/2001 Hinton ..... 42/87

FOREIGN PATENT DOCUMENTS

GB 654749 * 6/1951 ..... 42/87

* cited by examiner

*Primary Examiner*—Stephen M. Johnson
(74) *Attorney, Agent, or Firm*—Michael A. Shippey; Law Offices of Karla Shippey

(57) ABSTRACT

Ammunition feeder with a handle portion and a head portion. The handle portion is integrally attached to the head portion. The handle portion is a flat elongate shape having raised portions to help the user maintain his grip on the handle. The head portion is shaped to accept the front end of a standard ammunition belt. The head is flattened longitudinally on one side and includes a longitudinal recess so that the feed pawl on a standard machine gun is not activated by the head. A preferred embodiment includes that the feeder fits with the M 60 machine gun and the 240 Golf machine gun.

10 Claims, 6 Drawing Sheets

AMMUNITION FEEDER

CROSS REFERENCE TO RELATED APPLICATIONS

Not Applicable

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

This invention relates generally to the field of gun accessories and more specifically to an ammunition feeding device for a machine gun. Machine guns are well known. They allow a belt of ammunition containing a plurality of evenly spaced bullets to feed into the gun and be fired in rapid succession.

Traditionally, in machine guns such as the M 60 and the Golf 240, the operator must open a feed tray cover to insert the front end of the belt of ammunition.

This operation is time consuming which can result in loss of use of the weapon during a critical period in an attack. Additionally, the rail system containing the aiming mechanism is located on top of the feed tray, so opening the feed tray causes the rail system to come into close contact with the extremely hot gun barrel which can throw off the scope sight mechanism thereby forcing the user to waste more time in recalibrating the mechanism. Further more, loading a gun at night is difficult to do without lighting the area thereby potentially bringing unwanted attention to the user.

BRIEF SUMMARY OF THE INVENTION

The primary object of the invention is to provide an ammunition feeder that lets the user load a machine gun more quickly.

Another object of the invention is to provide an ammunition feeder that snaps onto standard NATO Linked ammunition.

Another object of the invention is to provide an ammunition feeder that lets the user load a machine gun without opening the feed tray.

A further object of the invention is to provide an ammunition feeder that results in less jams.

Yet another object of the invention is to provide an ammunition feeder that does not require the user to recalibrate the gun's aiming site.

Other objects and advantages of the present invention will become apparent from the following descriptions, taken in connection with the accompanying drawings, wherein, by way of illustration and example, an embodiment of the present invention is disclosed.

In accordance with a preferred embodiment of the invention, there is disclosed an ammunition feeder comprising: a handle portion, a head portion, said handle portion integrally attached to said head portion, said handle portion being made injection molded plastic into a flat elongate shape approximately seven and one half inches long, one inch wide and one eighth of an inch thick, said handle tapering to approximately one half of an inch at the junction point between said handle and said head, said handle having raised portions to help the user maintain his grip on said handle, said head portion shaped to receive the end of a standard ammunition belt, said head portion being approximately cylindrically shaped and approximately the diameter if a standard bullet contained in said standard ammunition belt, and said head being flattened longitudinally on one side and having a longitudinal recess so that the feed pawl on a standard machine gun is not activated by said head.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
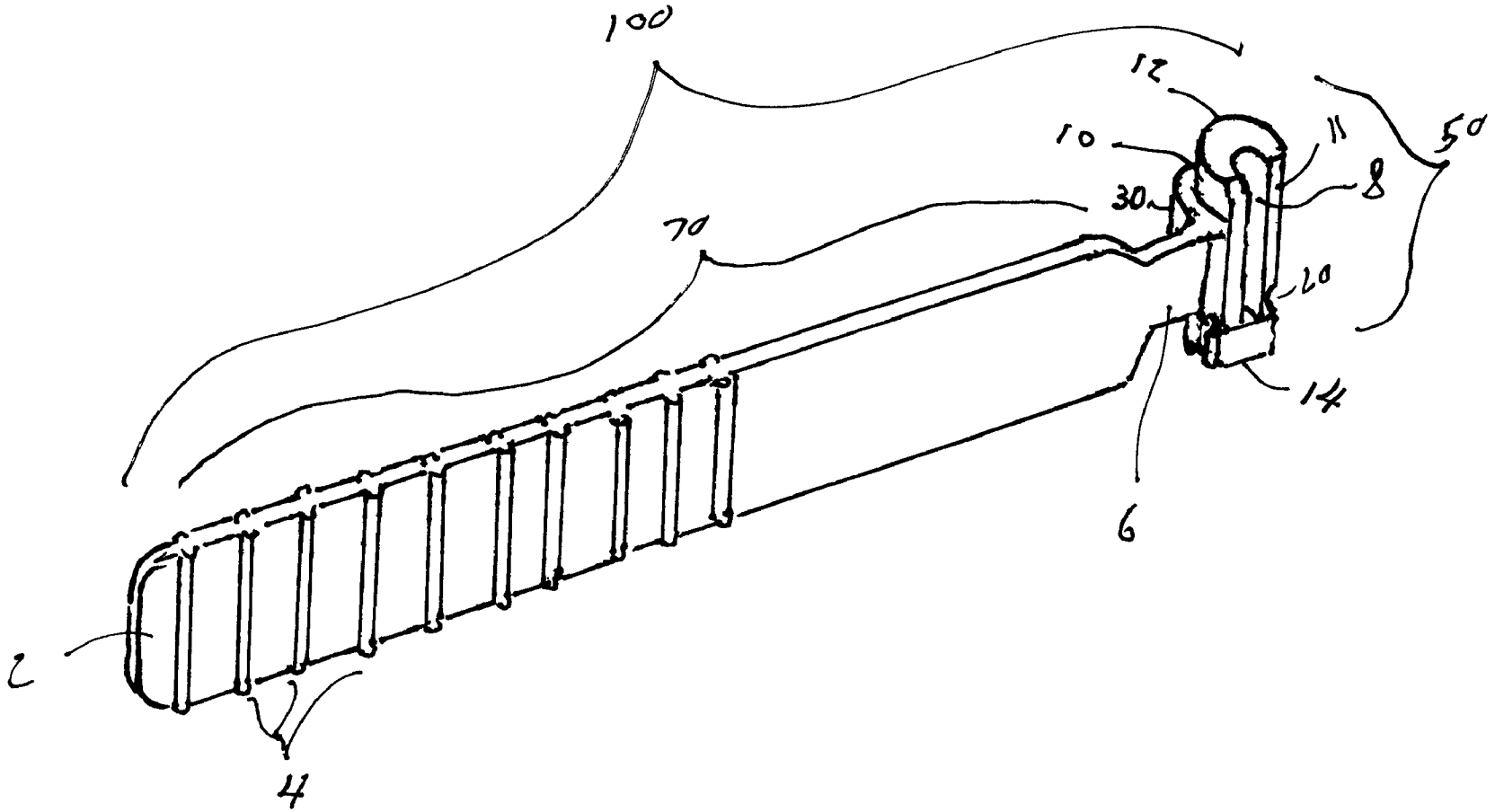
FIG. 1 is a perspective view of the invention showing the head top.
Figure 2:
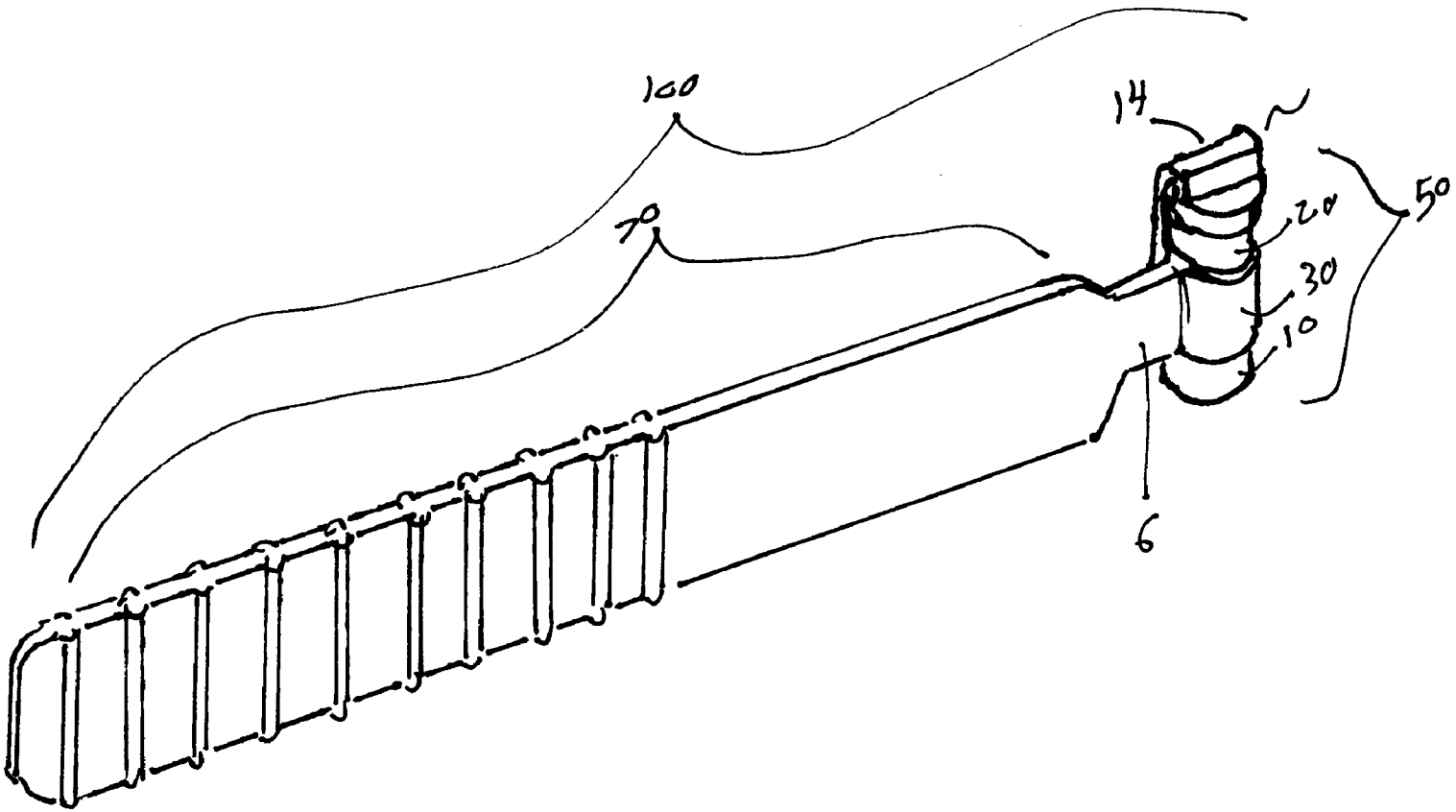
FIG. 2 is a perspective view of the invention showing the head bottom.
Figure 3:
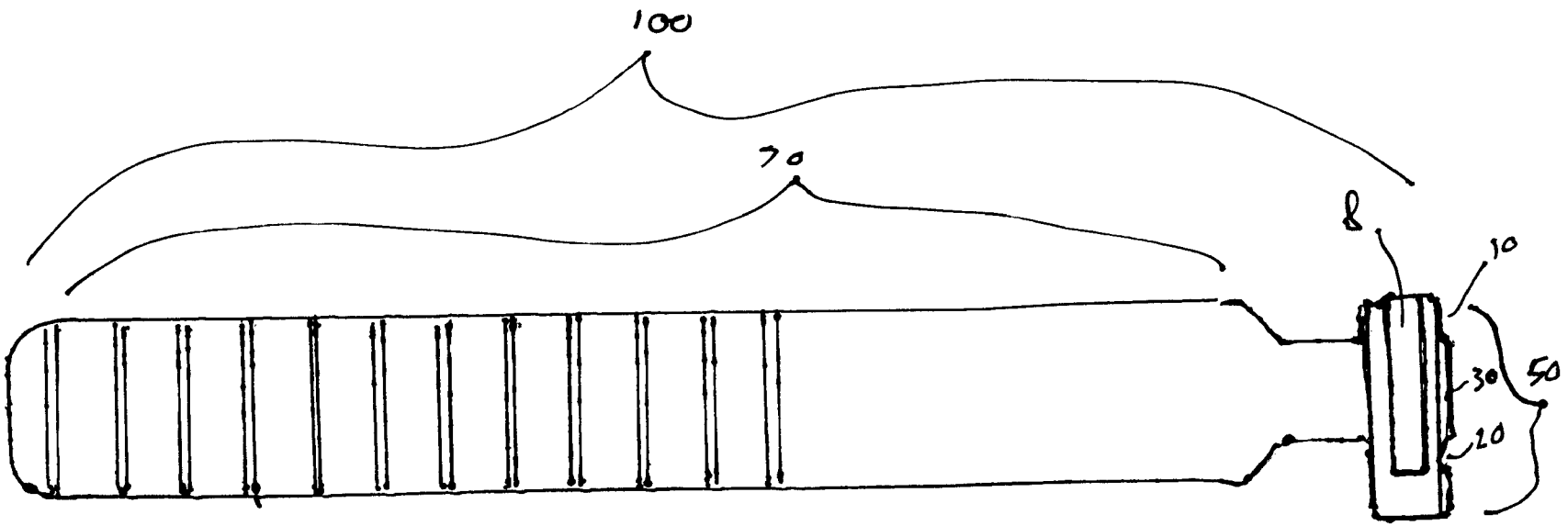
FIG. 3 is a front view of the invention.
Figure 4:
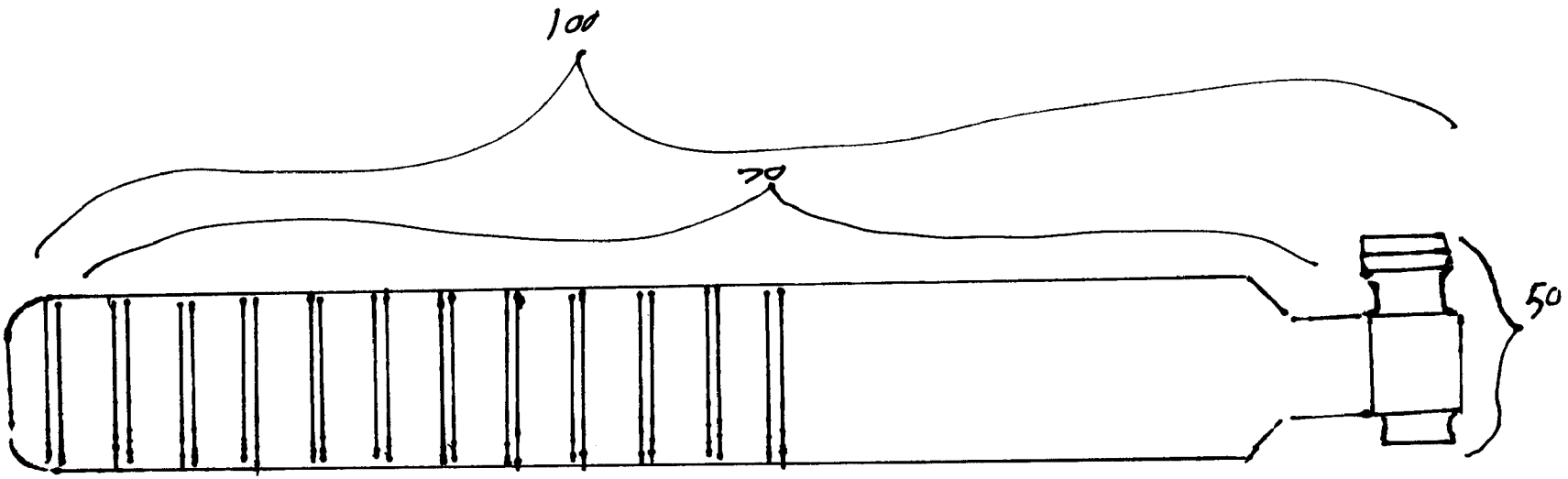
FIG. 4 is a back view of the invention.
Figure 5:
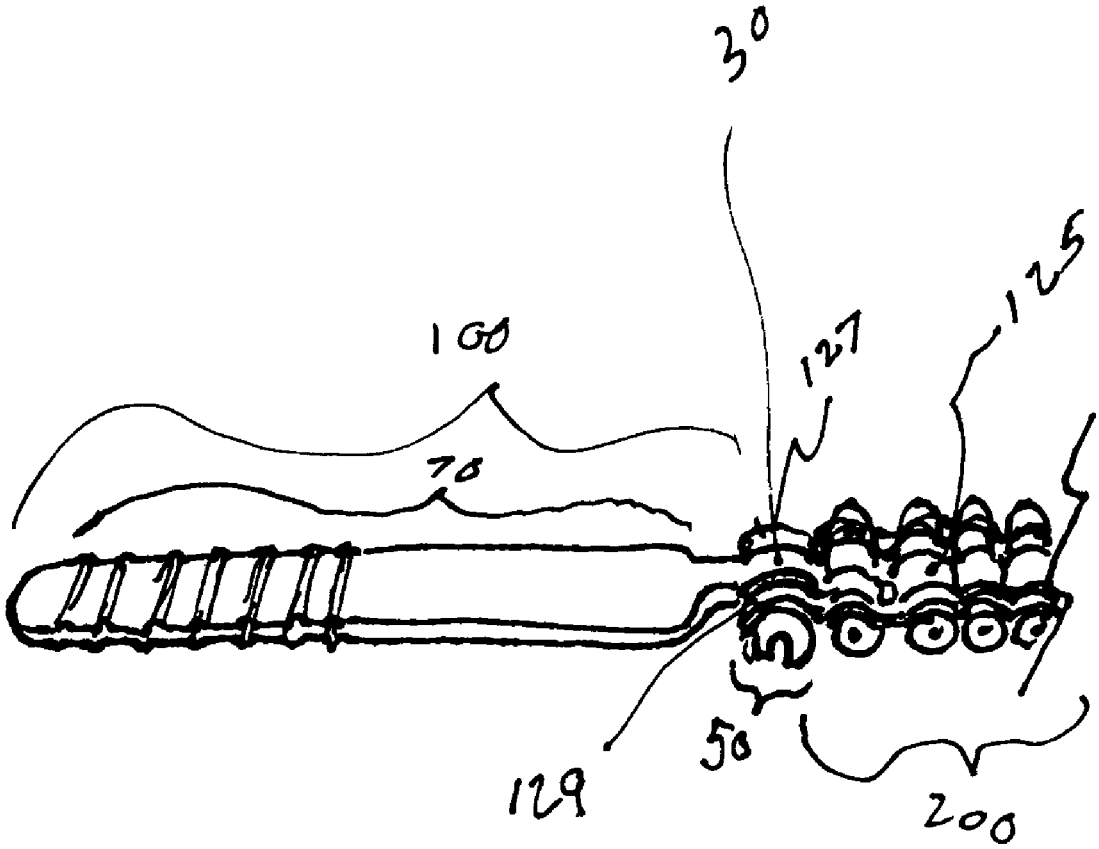
FIG. 5 is a perspective view of the invention in place on a belt of ammunition.
Figure 6:
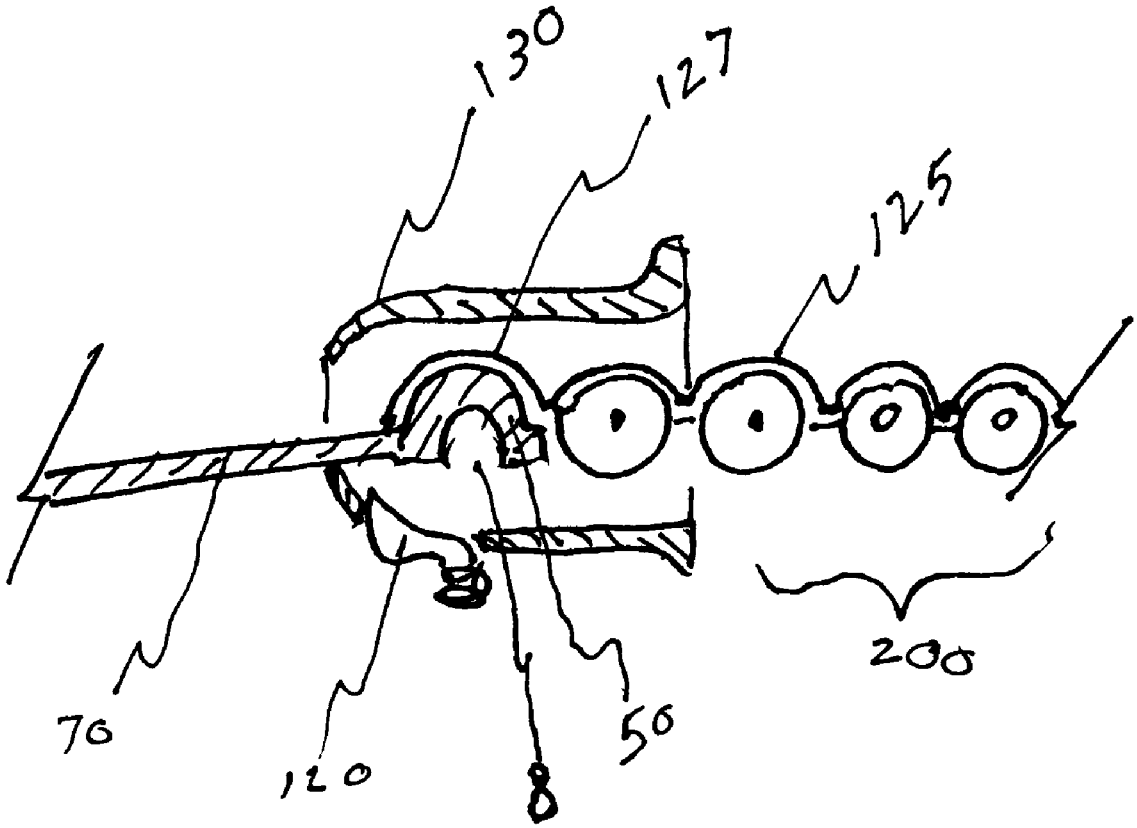
FIG. 6 is a side section view of the invention drawing in the belt clip into a standard machine gun.

Referring now to FIG. 1 we see a perspective view of the ammunition feeder of the present invention 100. The invention is comprised of a handle portion 70 and a head portion 50. The handle 70 and head 50 are integrally attached so that the head is at a right angle to the handle. The handle 70 is approximately seven and one half inches long, one inch wide and one eighth of an inch thick. The head 50 is in the general shape of a standard round of ammunition that is contained within a standard belt of ammunition. The head can be attached to the front of a standard belt of ammunition as shown in FIG. 5. In this way the user can slip the flat handle portion 70 into the feed chamber of a standard machine gun such as the M 60 or the Golf 240 and introduce the attached belt of ammunition 200 into the gun without opening the standard feed tray cover found on all current machine guns. One side of head 50 is flattened 11 and includes a recessed portion 8 so that the feed pawl 120 shown in FIG. 6 is not activated by the ammunition feeder device 100 of the present invention. FIG. 6 shows the present invention pulling a standard ammunition belt 200 into the feed chamber 130 of a standard machine gun. The junction point 6 between the handle 70 and the head 50 is narrowed to approximately one half of an inch to match the width of the belt clip portion 30 shown in FIG. 6. The handle portion 70 also acts to push out and clear any remaining shell casings that may have been left in the gun thereby eliminating gun jams. Handle portion 70 includes a plurality of raised ribs 4 to help improve the user's grip on the feeder of the present invention 100. The smaller diameter ends 10,20 of the head 50 allow the front portion of a standard ammunition belt to snap onto the ends 10, 20 and allow the top surface 127 of the front of the belt clip to be on the same plain with the central portion 30 of the head as shown in FIG. 5. The feeder 100 of the present invention is constructed of molded plastic such as sac which has a high melt point and is recognized by the military as being acceptable for this application. The handle portion 70 is hard yet somewhat flexible in nature and has a high resistance resulting from lateral stresses that may occur during operation. The head 50 shape can be modified to accommodate a variety of caliber of bullet including any 7.62 mm ammunition belt as well as 5.56 mm and 50 caliber belted ammunition. The handle portion 70 is designed to fit into any standard NATO linked ammunition. The present invention requires no changes to the machine gun or the ammunition belt. The present invention can make the belt loading Process up to ten times faster than traditional loading techniques. Additionally, because the present invention 100 allows the user to reload a machine gun without lifting the feed tray cover, the aiming apparatus located on top of the feed tray cover remains in place and does not have to be recalibrated. The resulting time saved during the reloading process is vital when in a combat situation where machine guns are brought to bear.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. Ammunition feeder comprising:

a handle portion;

a head portion;

said handle portion integrally attached to said head portion;

said handle portion made of injection molded plastic to a flat elongate shape approximately seven and one half inches long, one inch wide and one eighth of an inch thick;

said handle portion tapering to approximately one half of an inch at the junction point between said handle and said head;

said handle having raised portions to help the user maintain his grip on said handle;

said head portion attached at a right angle to said handle and shaped to allow the end of a standard an ammunition belt to snap onto it said head portion;

said head portion being approximately cylindrically shaped and approximately the diameter if of a standard bullet contained in said standard ammunition belt; and said head portion being flattened longitudinally on one side and including a longitudinally disposed recess so that the feed pawl on of a standard machine gun is not activated by said head portion.

2. Ammunition feeder as claimed in claim 1 wherein said head portion mates with a 7.62 mm machine gun.

3. Ammunition feeder as claimed in claim 1 wherein said head portion links easily to a 7.62 mm ammunition belt.

4. Ammunition feeder as claimed in claim 1 wherein said head portion accepts 5.56 mm belted ammunition.

5. Ammunition feeder as claimed in claim 1 wherein said ammunition feeder is constructed of stiff yet flexible plastic.

6. Ammunition feeder as claimed in claim 1 wherein said feeder allows the user to load ammunition into said machine gun without opening the feed tray of the gun.

7. Ammunition feeder as claimed in claim 1 wherein said feeder pushes empty shell casings from said machine gun outside the gun.

8. Ammunition feeder as claimed in claim 1 wherein said feeder helps reduce the time of loading said machine gun.

9. Ammunition feeder as claimed in claim 1 wherein said feeder can be used to load said machine gun at night and in conditions of low visibility.

10. Ammunition feeder as claimed in claim 1 wherein said heat portion accepts 50 caliber belted ammunition.

* * * * *